US007399514B2

(12) United States Patent
De Clerck

(10) Patent No.: US 7,399,514 B2
(45) Date of Patent: Jul. 15, 2008

(54) SYNTHETIC TURF

(75) Inventor: Jan De Clerck, Waasmunster (BE)

(73) Assignee: Domo Zele N.V., Zele (BE)

( * ) Notice: Subject to any disclaimer, the term of this patent is extended or adjusted under 35 U.S.C. 154(b) by 225 days.

(21) Appl. No.: 10/547,631

(22) PCT Filed: Mar. 5, 2004

(86) PCT No.: PCT/EP2004/002301

§ 371 (c)(1),
(2), (4) Date: Sep. 1, 2005

(87) PCT Pub. No.: WO2004/077914

PCT Pub. Date: Sep. 16, 2004

(65) Prior Publication Data

US 2006/0093783 A1 May 4, 2006

(30) Foreign Application Priority Data

Mar. 5, 2003 (EP) ..... 03447049

(51) Int. Cl.
*E01C 13/08* (2006.01)
*D02G 3/38* (2006.01)
*B32B 33/00* (2006.01)

(52) U.S. Cl. ..... 428/92; 428/97; 428/87; 428/17; 428/377; 57/210; 57/236

(58) Field of Classification Search ..... 428/17, 428/92, 97, 87, 373, 375, 377, 397, 400; 57/210, 224, 227, 235, 207, 236, 248, 260
See application file for complete search history.

(56) References Cited

U.S. PATENT DOCUMENTS 1,540,046 A * 6/1925 Waite ..... 57/235

(Continued)

FOREIGN PATENT DOCUMENTS

DE 4136444 A1 * 5/1993

(Continued)

OTHER PUBLICATIONS

International Search Report dated Jul. 30, 2004.

*Primary Examiner*—Cheryl Juska
(74) *Attorney, Agent, or Firm*—Knobbe, Martens, Olson & Bear, LLP

(57) ABSTRACT

The present invention provides new types of synthetic turf. The synthetic turf includes a pile fabric having a backing (1) and tufts (2) projecting therefrom. In one embodiment, at least a number of the tufts are made of a composite yarn formed by at least one fibrillated yarn (6) together with a number of individual filament yarns (7), in particular with so-called monofilament or monotape yarns. The fibrillated yarn and the individual filament yarns are preferably made of polyethylene so that the synthetic turf is sliding-friendly. In another embodiment, at least a number of the tufts are made of a composite yarn formed by monotape yarns twisted together with a number of the monofilament yarns. The monofilament and monotape yarns are preferably made of polyethylene so that the synthetic turf is sliding-friendly. The combination of a fibrillated yarn and individual filament yarns or the combination of monofilament and monotape yarns in a composite yarn allows immediate achievement of the look of natural grass, that is, without post-fibrillation, and avoids any visible difference in wear pattern between the different types of yarns. In another embodiment, the invention also provides improved particulate material for use as infill material for top-dressing a synthetic turf.

29 Claims, 1 Drawing Sheet

U.S. PATENT DOCUMENTS

| | | | | | |
|---|---|---|---|---|---|
| 1,738,098 | A | * | 12/1929 | Coram | 57/15 |
| 3,551,263 | A | * | 12/1970 | Carter et al. | 428/17 |
| 3,620,003 | A | | 11/1971 | Chopra | |
| 3,631,666 | A | * | 1/1972 | Kim | 57/6 |
| 3,735,579 | A | * | 5/1973 | Catlos | 57/260 |
| 3,940,522 | A | | 2/1976 | Wessells | |
| 4,337,283 | A | | 6/1982 | Haas, Jr. | |
| 4,433,536 | A | * | 2/1984 | O'Neil | 57/233 |
| 5,580,708 | A | * | 12/1996 | Kawai et al. | 430/507 |
| 5,887,416 | A | * | 3/1999 | Shimono et al. | 57/236 |
| 6,691,455 | B1 | * | 2/2004 | Bergevin | 47/1.01 R |
| 2002/0028307 | A1 | | 3/2002 | Prevost | |
| 2003/0039773 | A1 | * | 2/2003 | Paschal et al. | 428/17 |

FOREIGN PATENT DOCUMENTS

| | | |
|---|---|---|
| EP | 1 158 099 | 11/2001 |
| WO | WO 99/04074 | 1/1999 |
| WO | WO 01/98589 | 12/2001 |

* cited by examiner

SYNTHETIC TURF

RELATED APPLICATIONS

This application is the U.S. National Phase under 35 U.S.C. § 371 of International Application PCT/EP2004/002301, filed Mar. 5, 2004, which claims priority of EP 03447049.2, filed Mar. 5, 2003.

FIELD OF THE INVENTION

The present invention relates to a synthetic turf comprising a pile fabric having a backing and tufts projecting therefrom, the tufts comprising portions of individual filament yarns and portions of at least one fibrillated yarn which is comprised of a tape showing longitudinal slits forming laterally interconnected filaments, the individual filament yarns and the interconnected filaments having dimensions such as to resemble blades of grass. The present invention also relates to a synthetic turf comprising a pile fabric having a backing and tufts projecting therefrom, the tufts comprising portions of individual filament yarns comprising extruded monofilament yarns and monotape yarns, the monofilament yarns and monotape yarns having dimensions such as to resemble blades of grass.

BACKGROUND OF THE INVENTION

Synthetic or artificial turf is used more and more to replace natural grass turf on playing surfaces, in particular on sport fields like fields for playing football, rugby, tennis, golf, hockey, baseball etc. In order to provide a somewhat resilient surface, a top-dressing can be applied onto the backing layer. The thickness of this top-dressing is smaller than the height of the tufts so that the grass-like filaments project above the top-dressing. A top-dressed synthetic turf is disclosed for example in U.S. Pat. No. 4,337,283.

In practice, the top-dressing of so-called third generation synthetic grass fields usually consists of a hard layer and on top a layer of resilient granules, as for instance disclosed in WO 01/98589. This document discloses a synthetic grass assembly for installation on a supporting substrate comprising a pile fabric with a flexible sheet backing and a plurality of upstanding synthetic ribbons of a selected length. An infill layer of particulate material, selected from the group consisting of hard and resilient granules, is disposed interstitially between the upstanding ribbons upon the upper surface of the backing with a depth less than the length of the ribbons. The infill layer in particular comprises a bottom course of hard granules, disposed upon the top surface of the backing and a top course substantially exclusively of resilient granules disposed upon the bottom course.

Frequently applied resilient granular materials that may be used as infill materials may include mixtures of granulated rubber particles like SBR (styrene butadiene rubber) recycled from car tires, EPDM (ethylene-propylene-diene monomer), other vulcanised rubbers or rubber recycled form belts. However, these rubbers have several important disadvantages. In particular, they can not be re-used and have a limited life span since they loose there properties throughout use. Furthermore, the use of this type of rubbers in a top-dressing layer of a synthetic turf does not provide sufficient resilience or shock absorption. Most of the synthetic turf for football fields consists nowadays of pile fabric made of fibrillated yarn. This fibrillated yarn is usually made of polyethylene or of a mixture of polyethylene and polypropylene and is tufted on a machine with a needle distance of between ⅝" (≈15.8 mm) and 3/16" (≈4.7 mm). A drawback of the used fibrillated yarns is that they have a relatively low wear resistance and that a post-fibrillation with a rigid (steel) brush is required after having laid the synthetic turf. The post-fibrillation is required to separate the different filaments of the fibrillated yarn from one another in order to hide the topdressing better from view and in order to achieve the look of natural grass. A drawback of such a post-fibrillation is however that the pile yarn is damaged. In addition to synthetic turf made of fibrillated yarn, there is also synthetic turf made of so-called monotape or monofilament yarn. The difference between monotape and monofilament yarn is that, for the production of monotape yarn, a film is extruded which is cut into small bands whilst for the production of monofilament yarn the bands forming the monofilaments are separately extruded. A drawback of synthetic turf made of monotape or monofilaments is that the top-dressing is less stabilised against shifting and/or erosion and that the rubber granules are less hampered from jumping up. In practice, most of the monotape or monofilament yarns used to make artificial turf are moreover made of polypropylene which offers better resilience properties than polyethylene but which has a higher coefficient of friction so that burning wounds occur much quicker, for example when falling or making a sliding on the synthetic turf surface. Synthetic turfs formed by yarns made of polyamide have been reported in the art, and are for instance disclosed in U.S. Pat. No. 3,940,522 and WO 99/04074. In U.S. Pat. No. 3,940,522 synthetic turfs are described comprising grass-like synthetic fibers and crimped fibers. One or more of the grass-like fibers are combined with an appropriate multi-fiber strand of crimped and/or latently crimpable fibers. The fibers are made of polyamides such as nylon 6, nylon 6,6, nylon 6,10, nylon 6,12, and copolymers and blends of these. WO 99/04074 discloses yarns containing polyamide in combination with a polyolefin compound for producing artificial grass. A major disadvantage of this type of synthetic turfs formed by yarns made of polyamide is that the turfs show high sliding resistance, and a high coefficient of friction so that burning wounds occur much quicker, for example when falling or making a sliding on the synthetic turf surface.

In practice there is also a synthetic turf on the market comprising alternating rows of tufts made of fibrillated yarn and rows of tufts made of monofilament yarns. An advantage of such a combination is that the turf has an appearance which immediately resembles more natural grass. However, a post-fibrillation or several months of wear is still required to make the synthetic turf look like natural grass. A further drawback of this combination is that, due to the fact that the fibrillated yarn wears more quickly than the monofilament yarns, the difference in wear pattern between the fibrillated yarn and the monofilament yarns can clearly be seen after a more prolonged time of use.

It is an object of the present invention to provide a new type of synthetic turf that has more the look of natural grass, but which solves the problem of the difference in wear pattern which can be seen after a prolonged time of use of the prior art synthetic turf. It is another object of the invention to provide a synthetic turf having improved resilience, shock absorption and safeness (e.g. reducing the risks for skin burns when making a sliding on the turf surface).

SUMMARY OF THE INVENTION

To this end, the present invention provides in a first embodiment a synthetic turf which comprises a combination of fibrillated yarn and individual yarns. The synthetic turf is characterised according to the invention in that at least a number of said tufts are made of a composite yarn formed by said fibrillated yarn twined together with a number of said individual filament yarns.

Due to the fact that the fibrillated yarn and the individual filament yarns are combined in one composite yarn, no difference in wear pattern can be seen, at least not without a close inspection of the tufts. Moreover, it was found that due to the use of a composite yarn wherein the fibrillated yarn is twined together with the individual filament yarns, the synthetic turf immediately resembles better natural grass. In the synthetic grass surface, the fibrillated yarn portions are indeed more homogeneously mixed with the individual filament yarn portions so that no post-fibrillation is needed or so that the synthetic turf has not to be subjected to wear, or only for a short period of time, to achieve the appearance of natural grass.

In a preferred embodiment of the synthetic turf according to the invention, the fibrillated yarn has a yarn number which is selected, together with the number of individual filament yarns in the composite yarn, in such a manner that, without post-fibrillation of the free ends of the fibrillated yarn, the tufts made of the composite yarn resemble grass.

The composite yarn preferably comprises 4 to 10 individual filament yarns, and more preferably 6 to 8 individual filament yarns whilst the fibrillated yarn has preferably a yarn number higher than 2000, and preferably higher than 5000, but smaller than 11000, and preferably smaller than 8500 dtex.

In a further preferred embodiment of the synthetic turf according to the invention, at least the fibrillated yarn of said composite yarn, and preferably also at least a number of said individual filament yarns of said composite yarn, most preferably all of them, are made of polyethylene.

In another embodiment, the present invention provides a new type of synthetic turf which comprises a combination of monotape yarns and monofilament yarns. The synthetic turf is characterised according to the invention in that at least a number of said tufts are made of a composite yarn formed by said monotape yarns twisted together with a number of said monofilament yarns.

Due to the fact that the monotape yarns and the monofilament yarns are combined in one composite yarn, less difference in wear pattern even in comparison with the combination fibrillated yarn and monofilament yarn can be seen. This combination strongly resembles natural grass.

The composite yarn preferably comprises 1 to 6, and more preferably 1 to 3 monotape yarns whilst the monotape yarn has preferably a yarn number higher than 1000, and preferably higher than 2000 dtex, but smaller than 5000 dtex, and preferably smaller than 3000 dtex. The composite yarn has preferably a yarn number higher than 8000, and preferably higher than 9000 dtex, but smaller than 20000 dtex, and preferably smaller than 15000 dtex.

In a further preferred embodiment of the synthetic turf according to the invention, at least the monotape yarn of said composite yarn and preferably also at least a number of said monofilament yarns of said composite yarn, most preferably all of them, are made of polyethylene.

An important advantage of these embodiments is that the synthetic turf can be rendered more sliding-friendly, i.e. its coefficient of friction can be made smaller than for example the coefficient of friction of polypropylene so that burning wounds arise less quickly. Due to the fact that the individual filament yarns are twined together with a fibrillated yarn in the composite yarn, the smaller resilience properties of the polyethylene yarns compared to for example polypropylene yarns, are partially compensated for by the support offered by the fibrillated yarn. On the other hand, some of the individual filament yarns may be made of another polymer, in particular of a polymer which offers a better resiliency and/or which has a better wear resistance. Another advantage of the use of fibrillated and individual filament yarns which are all made of polyethylene instead of a combination of polyethylene and polypropylene is that the synthetic turf is easier to recycle. The synthetic turf has moreover a softer touch.

In a further embodiment the present invention also relates to a synthetic turf. characterised in that it is top-dressed with a layer of particulate (infill) material. In another embodiment, the invention provides for a particulate material which is particularly suitable for being used as infill material in synthetic turfs. The infill material comprises a polyolefin elastomer, preferably a low density ethylene/octene co-polymer. In a preferred embodiment, the particulate infill material is filled with filler material selected from the group comprising chalk or clay. Preferably, the amount of filler material in said infill material is comprised between 50 and 60% by weight and the amount of polyolefin elastomer in said infill material is comprised between 40 and 50% by weight.

In another embodiment, the present invention relates to a composite yarn characterized in that said composite yarn is formed by a fibrillated yarn twined together with a number of individual filament yarns. In yet another embodiment, the present invention relates to a composite yarn characterized in that said composite yarn is formed by monotape yarns twisted together with a number of monofilament yarns.

The present invention further relates to the use of the above-mentioned composite yarns as tufts in a synthetic turf. The present invention also relates to the use of the above-mentioned composite yarns as tufts in a natural grass system for reinforcing and stabilising natural grass roots.

Other particularities and advantages of the invention will become apparent from the following description of some particular embodiments of the synthetic turf according to the present invention. The reference numerals used in this description relate to the annexed drawings.

DETAILED DESCRIPTION OF THE FIGURES

DETAILED DESCRIPTION OF THE INVENTION

Figure 4:
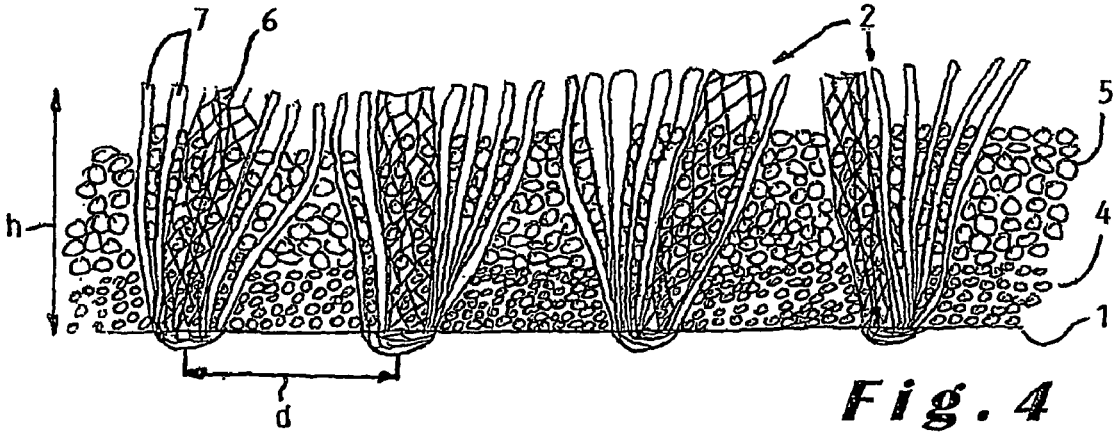
FIG. 4 is a schematic cross-sectional view through a synthetic turf comprising a backing layer and tufts made of the composite yarn illustrated in FIG. 3, the synthetic turf being further filled with a top-dressing.

The synthetic or artificial turf illustrated in FIG. 4 comprises a flexible backing layer 1 provided with rows of tufts 2 made of a composite yarn 3. The synthetic turf is more particularly formed by a cut pile fabric. For producing such a pile fabric; the composite or combined yarn 3 is fed through the needles of a tufting machine and is inserted through the backing layer to form pile loops. The pile loops are then cut by knives to form the cut pile fabric and latex, foam or another adhesive material is applied to the underside of the fabric to secure the pile fibres to the backing. The backing layer 1 may consist for example of a woven polypropylene sheet and a glass fibre netting fixed by means of the above described adhesive material to the polypropylene sheet. Since the backing layer is no essential feature of the present invention, no further details will be described thereof.

In an embodiment, in the synthetic turf according to the invention, at least a number of the tufts 2 are made of a composite yarn 3 which is formed by at least one fibrillated yarn 6 twined together with a number of individual filament yarns 7. The fibrillated yarn 6 and the individual filament yarns 7 are preferably made of polyethylene, although it is possible to make the individual filament yarns, or at least some of them, of another polymer, for example of a polymer which provides a higher resiliency and/or which has better wear properties. Especially when making all the yarns of polyethylene, the synthetic turf has a smaller coefficient of friction so that burning wounds arise less quickly. The synthetic turf is moreover easier to recycle. Furthermore, since all the filaments are made of the same material, it is easier to avoid colour differences. Another advantage of polyethylene is that it has a higher wear resistance than for example polypropylene. For a skilled person it is clear that the polyethylene contains certain additives such as UV and heat stabilisers, colour pigments and/or colorants. Optionally, it may even contain small amounts of one or more other polymers, more particularly in an amount of less than 10% by weight, preferably less than 5% by weight.

Figure 2:
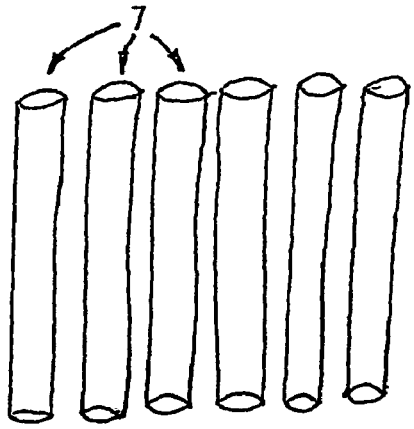
FIG. 2 is a schematic view on six monofilament yarns.

The individual filaments yarns 7 may be so-called monotape yarns produced by cutting an extruded film into narrow bands. The extruded film is preferably led over stretching drums to organise the molecules so that the strength of the film is increased. Instead of first producing a film, a more preferred way to produce the individual filament yarns is to extrude them directly into the desired size so that no cutting operation is required. In this way, preferably also after a stretching step, a so-called monofilament yarn is obtained. FIG. 2 illustrates six monofilament yarns 7. These yarns have such a thickness and a width that they resemble grass blades. The width of the yarns is preferably smaller than 4 mm, more preferably smaller than 3 mm, and most preferably smaller than 2 mm, but larger than 0.8 mm, preferably larger than 1 mm. A fine, natural grass look is for example obtained when the width of the filaments comprises about 1.4 mm. The thickness of the individual filament yarns 7 is not only important to achieve the look of natural grass, but also to achieve the required resilience properties. The individual filament yarns will usually have a thickness of between: 100 and 200 μm. Especially for polyethylene yarns, which provide less resiliency than for example polypropylene yarns, the individual filament yarns have preferably a thickness larger than 125 μm, and more preferably a thickness larger than 135 μm. Good results have for example been obtained when the thickness of the individual filament yarns comprises about 160 μm. The yarn number of the individual filament yarns will usually be comprised between 1000 and 3000 dtex in order to resemble grass, and will more preferably be comprised between 1100 and 1700 dtex. The individual filament yarns may have for example a yarn number of about 1400 dtex.

Figure 1:
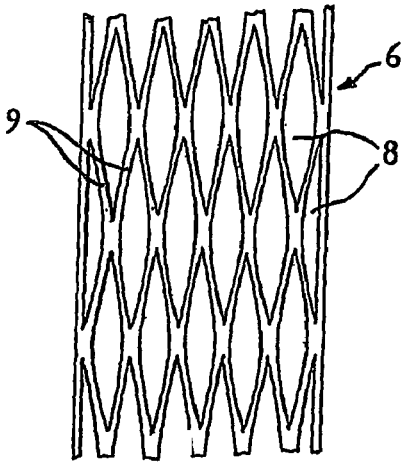
FIG. 1 is a schematic side elevational view on a fibrillated yarn to which a lateral tension is exerted.

Turning now to FIG. 1 there is illustrated an example of a fibrillated yarn 6. Such a fibrillated yarn is produced starting from an extruded film which is first cut into bands. In these bands longitudinal slits 8 are made so that laterally interconnected filaments 9 are formed. These slits can be made for example by means of a drum provided with needles (and rotated at a speed different from the speed of the film led over this drum) or teeth as disclosed in U.S. Pat. No. 3,496,259. In FIG. 1 the fibrillated yarn is shown in a laterally stretched state so that the slits are drawn open and a structure resembling a honeycomb is obtained.

The fibrillated yarn 6 has for example a total width of 9 mm, the slits 8 being arranged so that the interconnected filaments 9 have a width which is preferably somewhat smaller than the width of the individual filament yarns. Moreover, the slits are preferably not provided on the same mutual distances so that broader filaments are separated by narrower filaments which provide for a looser connection between the broader filaments. By selecting a smaller width of the filaments and/or a looser connection between the filaments, the filaments become immediately spread in a random manner after the tufting operation thus contributing to achieving immediately the natural look of grass. The yarn number of the fibrillated yarn will normally be higher than 2000 dtex and will usually be comprised between 5000 and 11000 dtex, and preferably between 5000 and 8500 dtex. When using a fibrillated yarn with a smaller yarn number, the composite yarn may contain more individual filament yarns since the maximum yarn number of the composite yarn is limited by the tufting technique. The composite yarn can for example be made with three fibrillated yarns, having each a yarn number of 2000 dtex. These fibrillated yarns can first be twined together and can subsequently, in a second twining operation, be twined together with the individual filament yarns. The thickness of the fibrillated yarn is preferably comprised between 60 and 100 μm, and more preferably between 70 and 90 μm. Since the filaments of the fibrillated yarn are interconnected, the thickness thereof may be smaller than the thickness of the individual filament yarns. A predetermined minimum thickness is however preferred in view of the increased wear resistance (mechanical wear and/or heat and UV degradation) and the increased resiliency obtained with a larger thickness.

By making the tufts of the pile fabric as described hereabove by means of a composite yarn 3, the yarn number of the fibrillated yarn 6 and the number of individual filament yarns 7 can be easily selected in such a manner that, without post-fibrillation, the pile fabric immediately resembles grass.

The composite yarn 3 will usually comprise 4 to 10, preferably 6 to 8, individual filament yarns 7. It may comprise more than one fibrillated yarn 6 but preference is given to the presence of only one fibrillated yarn. When only one fibrillated yarn is present, it may have a larger yarn number so that the filaments are better connected with one another. The yarn number of the composite yarn is indeed preferably formed for at least 40%, more preferably for at least 50%, by the individual filament yarns in view of resembling immediately as much as possible natural grass. On the other hand, in view of better stabilising the top-dressing, preferably at least 30%, and more preferably at least 35% of the yarn number of the composite yarn is formed by the fibrillated yarn or yarns. In order to be able to provide, on the one hand, a fibrillated yarn with a relatively high yarn number and, on the other hand, a relatively large number of individual filament yarns, the yarn number of the composite yarn 3 will usually be larger than 9000, and preferably larger than 11000 dtex. Due to the limitations of the tufting machines, the yarn number of the composite yarn will usually be smaller than 20000 and more particularly smaller than 17000 dtex.

In the composite yarn according to the invention the fibrillated yarn 6 is preferably twined around the individual filament yarns 7 so that the composite yarn has an outer surface which is mainly formed by the fibrillated yarn.

Figure 3:
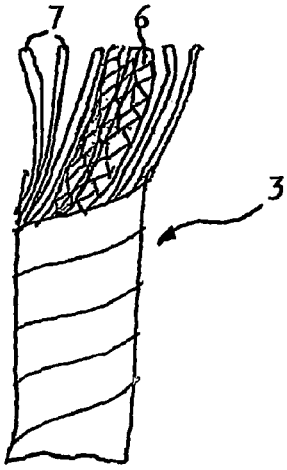
FIG. 3 is a side elevational view on a composite yarn composed of a fibrillated yarn as illustrated in FIG. 1 and six monofilament yarns as illustrated in FIG. 2, the fibrillated yarn and the monofilament yarns being twined together so that the fibrillated yarn is twisted on the outside around the monofilament yarns.

In order to make the composite yarn 3, the individual filament yarns 7 and the fibrillated yarn 6 are twined together. The word. "twined" has to be understood here in its broadest meaning and includes for example also a simple twisting of the yarns. The composite yarn may further be twined in the S or Z direction. The number of windings (per meter) during the twining process must be limited in such a manner that the filaments will spread themselves again after the tufting process. This can be determined experimentally. When twining the composite yarn, the fibrillated yarn is preferably twined around the individual filament yarns so that the composite yarn has an outer surface which is mainly formed by the fibrillated yarn. This is clearly illustrated in FIG. 3. An advantage of such a way of twining is that the composite yarn can be tufted more easily and that, when applying the adhesive material on the backing layer, the filaments are kept better in place so that a nice back finishing is obtained.

In another embodiment, in the synthetic turf according to the invention, at least a number of the tufts are made of a composite yarn which is formed by monotape yarn twisted together with a number of monofilament yarns. The monotape yarn and the monofilament yarns are preferably made of polyethylene, although it is possible to make the monofilament yarns, or at least some of them, of another polymer, for example of a polymer which provides a higher resiliency and/or which has better wear properties. Especially when making all the yarns of polyethylene, the synthetic turf has a smaller coefficient of friction so that burning wounds arise less quickly. The synthetic turf is moreover easier to recycle. Furthermore, since all the filaments are made of the same material, it is easier to avoid colour differences. Another advantage of polyethylene is that it has a higher wear resistance than for example polypropylene. For a skilled person it is clear that the polyethylene contains certain additives such as UV and heat stabilisers, colour pigments and/or colorants. Optionally, it may even contain small amounts of one or more other polymers, more particularly in an amount of less than 10% by weight, preferably less than 5% by weight.

The monotape yarns and the monofilament yarns applied in the combined yarn have such a thickness and a width as to resemble grass blades. The width of the monotape yarn is preferably larger than 1.5 mm, more preferably larger than 2 mm and preferably smaller than 3 mm. The thickness of monotape yarn is not only important to achieve the look of natural grass, but also to achieve the required resilience properties. The monotape yarns will usually have a thickness of between 100 and 150 μm, and preferably of between 100 and 120 μm. The yarn number of the monotape yarns will usually be comprised between 1000 and 5000 dtex in order to resemble grass, and will more preferably be comprised between 2000 and 3000 dtex.

The composite yarn will usually comprise 1 to 6 and preferably 1 to 3 monotape yarns and 2 to 8, and preferably 4 to 6 monofilament yarns. The yarn number of the composite yarn is preferably formed for at least 30%, more preferably for at least 40% by the monotape yarn in view of resembling immediately as much as possible natural grass. More preferably, the yarn number of the composite yarn is formed for at least 40% and at most 50% by the monotape yarn. The yarn number of the composite yarn will usually be higher than 8000, and preferably higher than 9000 dtex. Due to the limitations of the tufting machines, the yarn number of the composite yarn will usually be smaller than 20000 and more particularly smaller than 15000 dtex.

In another preferred embodiment, in the composite yarn according to the invention the monotape yarn is preferably twined around the monofilament yarns so that the composite yarn has an outer surface which is mainly formed by the monotape yarn.

In view of the relatively high yarn number of the composite yarns according to the present invention, the distances between the rows of tufts may be larger. Usually, the mutual distances between the rows will be comprised between 8 and 24 mm, preferably between 10 and 20 mm, and more preferably between 12 and 18 mm. A mutual distance of 16 mm or larger is most preferred.

In order to enable the presence of a top-dressing, the tufts 2 of the synthetic turf have preferably an average height larger than 30 mm and more preferably an average height larger than 40 mm. In this way, the tufts of the pile layer still project over a sufficient distance above the top-dressing. The average height of the tufts 2 is usually smaller than 75 mm and is preferably comprised between 50 and 60 mm. The average height of the tufts is to be determined by measuring and totalling the height of the different filaments and dividing the achieved number by the number of filaments.

Synthetic turf is generally used to replace natural grass on playing surfaces. In order to provide a somewhat resilient surface, a top-dressing can be applied onto the backing layer. The synthetic turf according to the present invention is preferably arranged to be top-dressed with a layer of at least one particulate material. The thickness of this top-dressing is smaller than the height of the tufts so that the grass-like fibres as mentioned above project above the top-dressing. Preferably the thickness of this top-dressing comprises between 0.5 and 3.0 cm and more preferably between 1.0 and 2.0 cm.

In practice, the top-dressing of so-called synthetic grass fields usually consists of a hard layer and on top a layer of resilient granules including mixtures of granulated rubber particles like recycled SBR from car tires, EPDM, other vulcanised rubbers, recycled rubber form belts and even thermoplastic elastomers based on SEBS (styrene-ethylene-butadiene-styrene). In the embodiment of FIG. 4, the synthetic turf is first filled with a layer of sand 4 and, on top of that, with a layer of rubber granules 5. In this way, a resilient, non-abrasive surface is achieved.

Presently, about 90% of the infill used for football pitches is based on SBR rubber recycled from truck tyres. However, this kind of rubber has a number of disadvantages including the possibility of migration of the existing aromatic oils which will attack the polyolefine yarns, and the release of an unpleasant smell above 25° C. Furthermore, the possibility exists that a field can be heated up to 70° C., due to the black carbon in the rubber, which might be dangerous since skin burns can be affected by T° above 60° C. Other disadvantages include that the leaching of zinc (vulcanisation process) does not fulfil standard norms and that the rubber is not fire retardant. Also, in this kind of rubber sulphur may be present, which attacks the UV stabilisation of the yarn. When the rubber is not properly processed, steel may be formed. Also, the use of this kind of rubber only provides black colours which give an unnatural look to the synthetic turf.

Because of all these disadvantages of the recycled black rubber from tires, new alternatives were introduced. New compounds/produced materials such as EPDM or TPVs (thermoplastic vulcanizates) in which no sulphur with zinc oxide curing system is used were applied. Advantages of these rubbers include that they can be coloured in any colour. Beige colours give a temperature which is 10 to 20° C. lower at sunny weather during summer than previously used rubber. The rubbers fulfil requirements of standard norm (DIN 18035-7) and are fire retarding. However, some important disadvantages of these rubbers remain that the rubbers are not recyclable, that they do not provide optimised playing characteristics, that they give a bad smell, and that they have a very high filler content of more than 80%. Furthermore, granules of a bad quality of EPDM rubber loose their shape and are melted together after several months.

In order to overcome this problem, the present invention provides a synthetic turf, characterised in that it is top-dressed with a layer of particulate infill material comprising a polyolefin elastomer. Preferably said polyolefin elastomer is a low density ethylene/octene co-polymer. However, it should be clear from the present invention that also other polyolefin elastomers, such as but not limited to EPM may be applied.

Referring now to the low density ethylene/octene co-polymer, the more efficient and consistent incorporation of octene co-monomer into a polyethylene backbone, made possible by a metallocene catalyst, results in lower density and more narrowly defined polymers with a range of benefits including flexural modulus similar to elastomers, thermoplastic behaviour without plasticizers, exceptional compatibility with other polyolefines providing the opportunity to blend with EPM, exceptional toughness, puncture resistance, flexibility even at very low temperature (below −20° C.), very low extractable and surface softness. The resilient infill based on ethylene/octene co-polymer bridges the gap between plastics and elastomers and as such combines many of the physical properties of a rubber with the processing advantages of a thermoplastic. The ethylene/octene copolymers are at the extreme performance end in terms of overall toughness.

The resilient infill material, in particular based on ethylene/octene copolymer, can be filled with a filler, preferably chalk or clay, to reduce the costs.

The infill material is preferably provided in the form of granules, which can be round, spherical or angular, and which are preferably round or spherical. Preferably, the particulate material comprises granules consisting of polyolefin elastomer and filler.

The amount of polyolefine elastomer in the resilient infill granules is preferably minimum between 20%-60% and maximum between 40%-100% by weight and more preferably minimum between 30%-50% and maximum between 40%-50% by weight.

In another preferred embodiment, the synthetic turf according to the invention is characterised in that the amount of filler material in said particulate material is comprised between 50 and 60% by weight and that the amount of polyolefin elastomer in said particulate material is comprised between 40 and 50% by weight.

In a further preferred embodiment, the resilient infill granules based on ethylene/octene copolymer can be blended with EPM (ethylene propylene copolymer). The amount of EPM preferably comprises maximum between 0%-20% by weight more preferably maximum between 0%-5% by weight. A higher amount of EPM will affect the mechanical properties.

The diameter of the resilient infill granules can be between 0.5 and 3 mm, and preferably between 0.5 and 2.5 mm, and more preferably between 1.0 and 2.5 mm. The compound density of the resilient infill granules is between 1.3 and 1.5 kg/dm$^3$. The bulk density of the resilient infill granules is between 0.6 and 1.0 kg/dm$^3$.

Other features are constant granulometry, dust free, the fact that the material is not recycled, not milled from scraps, the thermoplastic elastomer does not need vulcanisation, is recyclable, and can be re-used at end-life, and is thus ecological durable, the infill granules are UV and Ozone stable, non-toxic and not allergic, heavy metal free, PVC and phthalate free and not reactive in tight contact with PP and PE of the artificial turf. The present particulate material is particularly suitable for use as infill material in synthetic turf and in particular for top-dressing a synthetic turf.

The resilient infill system according to the invention will retain its properties throughout use without compaction of the infill material. Furthermore, the infill system in accordance with the present invention, in combination with the synthetic turfs according to the invention, permits to improve playing conditions and to reach natural grass characteristics and further players acceptance. The synthetic turf, provided with a top-dressed layer according to the present invention fulfils the FIFA and UEFA requirements based on shock absorption; energy restitution; ball bounce and ball roll. The present infill system eliminates all leaching problems and provides a resilient infill which satisfies the ecological requirements and playing properties similar to those of natural grass.

In another embodiment, the present invention relates to the use of a composite yarn formed by a fibrillated yarn twined together with a number of individual filament yarns and to the use of a composite yarn formed by monotape yarns twisted together with a number of monofilament yarns as tufts in a synthetic turf.

In addition, the above-mentioned composite yarns can also be applied in a natural grass system. The present composite yarns may be applied in natural grass systems comprising grass tiles with roots for reinforcing and stabilising the natural turf. In practice, the synthetic yarns may be inserted below the grass surface for root reinforcement and additional wear resistance, while not interfering with the naturalness of the playing grass surface itself. The synthetic yarns can be sewn into natural grass sod. The grass roots of the natural system intertwine with the tufts of composite yarns and thereby become reinforced and stabilised. The roots of the natural grass use the synthetic yarns as an anchor and soil stabiliser to help prevent field stress from excessive play. The grass roots become entwined with the synthetic yarns, which, in turn hold the grass in place and the new growth replaces the worn areas of grass.

EXAMPLE 1

A composite yarn 3 was first made by twining one fibrillated yarn 6 around six monofilament yarns 7. The fibrillated yarn had a yarn number of 6600 dtex and a thickness of 80 μm. The slits were arranged on such mutual distances d that the filaments had varying widths, more particularly width varying between about 0.1 mm and about 1.2 mm. The monofilament yarns each had a yarn number of 1400 dtex, a thickness of 160 μm and a width of 1.4 mm. The yarn number of the composite yarn comprised 15000 dtex. The different yarns were all made of polyethylene containing UV and heat stabilisers and a green pigment. The composite yarn was tufted on a backing layer consisting of a woven polypropylene layer and a glass fibre netting. The needle distance of the tufting machine was set at ⅝". The tufts had an average height h of about 5 cm. A latex adhesive was applied on the back of the backing layer to fix the tufts. The achieved synthetic grass is illustrated in FIG. 4. In the cross-sectional view of this figure, only one portion of the composite yarn is shown for each tuft. In practice, each tuft comprises, due to the tufting technique, two portions of the composite yarn, the filaments of both portions being intermixed with one another. To finish the synthetic turf, it was filled with a layer of sand 30 and subsequently with a layer of rubber granules. The synthetic turf immediately resembled natural grass, i.e. no post-fibrillation or wear was necessary to achieve this look.

EXAMPLE 2

A composite yarn was made by twining two monotapes around four monofilament yarns. The monotape yarn had a yarn number of 2200 dtex and a thickness of 100 μm. The width of the monotape yarn was 2.5 mm. The monofilament yarn had a yarn number of 1400 dtex and a thickness of 160 μm. The width of the monofilament was 1.4 mm. The yarn number of the composite yarn was 10000 dtex. The composite yarn was tufted on a backing layer consisting of a woven polypropylene layer and a glass fibre netting. A latex adhesive was applied on the back of the backing layer to fix the tufts. The synthetic turf immediately resembled natural grass, i.e. no post-fibrillation or wear was necessary to achieve this look.

From the above given description of some preferred embodiments of the synthetic turf according to the invention, it will be clear that further modifications can be applied thereto provided they still fall within the scope of the invention as determined by the annexed claims.

Instead of using the twined composite yarn directly for tufting the synthetic turf, it can for example first be knitted-deknitted to achieve a frizzled structure. The rows of tufts do further not all have to be made of the composite yarn but some rows could for example be made of monofilament yarns. To achieve the most optimal stabilising effect, and in order to avoid any difference in wear pattern, all the rows of tufts are however preferably made of the composite yarn.

What is claimed is:

1. A synthetic turf comprising a pile fabric having a backing and tufts projecting therefrom, the tufts comprising portions of individual filament yarns and portions of at least one fibrillated yarn which is comprised of a tape showing longitudinal slits forming laterally interconnected filaments, wherein at least a number of said tufts are made of a composite yarn formed by said fibrillated yarn twined together with a number of said individual filament yarns, wherein the fibrillated yarn of said composite yarn and also at least a number of said individual filament yarns of said composite yarn, are made of polyethylene, and wherein in said composite yarn said fibrillated yarn is twined around the individual filament yarns so that the composite yarn has an outer surface which is mainly formed by the fibrillated yarn.

2. The synthetic turf according to claim 1, wherein said fibrillated yarn has a yarn number which is selected, together with the number of individual filament yarns in said composite yarn, in such a manner that, without post-fibrillation of the free ends of said fibrillated yarn, the tufts made of the composite yarn resemble grass.

3. The synthetic turf according to claim 1, wherein said composite yarn comprises 4 to 10 individual filament yarns.

4. The synthetic turf according to claim 1, wherein said individual filament yarns each have a yarn number of between 1000 and 3000 dtex.

5. The synthetic turf according to claim 1, wherein said individual filament yarns have a thickness of between 100 and 200 μm.

6. The synthetic turf according to claim 1, wherein said fibrillated yarn has a yarn number higher than 2000 dtex.

7. The synthetic turf according to claim 1, wherein said fibrillated yarn has a thickness of between 60 and 100 μm.

8. The synthetic turf according to claim 1, wherein said composite yarn has a yarn number larger than 9000 dtex, and smaller than 20000 dtex.

9. The synthetic turf according to claim 1, wherein said composite yarn has a yarn number, at least 40% of which, is formed by said individual filament yarns, said fibrillated yarn (6) forming preferably at least 30%, of the yarn number of the composite yarn.

10. The synthetic turf according to claim 1, wherein said individual filament yarns comprise extruded monofilament yarns and/or monotape yarns cut from an extruded film.

11. The synthetic turf according to claim 10 wherein the monotape yarn of said composite yarn and the monofilament yarns of said composite yarn are made of polyethylene.

12. The synthetic turf according to claim 1, wherein said tufts are arranged in rows which are situated on mutual distances, measured from centre to centre, of between 8 and 24 mm.

13. The synthetic turf according to claim 1, wherein said tufts have an average height larger than 30 mm.

14. The synthetic turf according to claim 1, wherein it is top-dressed with a layer of at least one particulate material.

15. The synthetic turf according to claim 14, wherein said particulate material comprises a polyolefin elastomer.

16. The synthetic turf according to claim 15, wherein the amount of filler material in said particulate material is between 50 and 60% by weight and the amount of polyolefin elastomer in said particulate material is between 40 and 50% by weight.

17. The synthetic turf according to claim 14, wherein the particulate material is filled with filler material selected from the group consisting of chalk and clay.

18. The synthetic turf according to claim 14, wherein the particulate material comprises a polyolefin elastomer blend with EPM.

19. The synthetic turf according to claim 18, wherein the amount of EPM in said infill material is between 0% and 20% by weight.

20. The synthetic turf according to claim 14, wherein said particulate material is provided in the form of granules.

21. The synthetic turf according to claim 20, wherein the granules have a diameter between 0.5 and 3.0 mm.

22. The synthetic turf according to claim 20, wherein the granules have a compound density of between 1.3 and 1.5 $kg/dm^3$ and a bulk density of between 0.6 and 1.0 $kg/dm^3$.

23. A composite yarn for use in a synthetic turf according to claim 1, wherein said composite yarn is formed by a fibrillated yarn twined together with a number of individual filament yarns, and wherein in said composite yarn said fibrillated yarn is twined around the individual filament yarns so that the composite yarn has an outer surface which is mainly formed by the fibrillated yarn.

24. The composite yarn according to claim 23, wherein said composite yarn has a yarn number smaller than 20000 dtex.

25. The composite yarn according to claim 23, wherein said composite yarn has a yarn number, at least 40% of which, is formed by said individual filament yarns, said fibrillated yarn forming at least 30% of the yarn number of the composite yarn.

26. The composite yarn according to claim 23, wherein said composite yarn comprises 4 to 10 individual filament yarns.

27. A synthetic turf comprising the composite yarn according to claim 23.

28. A natural grass system comprising the composite yarn according to claim 23 as tufts.

29. The synthetic turf according to claim 1, wherein all of said individual filament yarns of said composite yarn are made of polyethylene.

* * * * *

UNITED STATES PATENT AND TRADEMARK OFFICE

CERTIFICATE OF CORRECTION

PATENT NO. : 7,399,514 B2
APPLICATION NO. : 10/547631
DATED : July 15, 2008
INVENTOR(S) : Jan De Clerck It is certified that error appears in the above-identified patent and that said Letters Patent is hereby corrected as shown below:

On the Title Page (Item) -30- Foreign Application Priority Data, "03447049" should be changed to --03447049.2--

Signed and Sealed this

Twenty-third Day of December, 2008

JON W. DUDAS
*Director of the United States Patent and Trademark Office*